US006820790B2

(12) United States Patent
Ura

(10) Patent No.: US 6,820,790 B2
(45) Date of Patent: Nov. 23, 2004

(54) CLINCH MECHANISM FOR STAPLER AND ELECTRIC STAPLER USING THE SAME

(75) Inventor: Toshikazu Ura, Mino (JP)

(73) Assignee: Matsushita Electric Industrial Co., Ltd, Osaka (JP)

( * ) Notice: Subject to any disclaimer, the term of this patent is extended or adjusted under 35 U.S.C. 154(b) by 0 days.

(21) Appl. No.: 10/660,586

(22) Filed: Sep. 12, 2003

(65) Prior Publication Data

US 2004/0060959 A1 Apr. 1, 2004

(30) Foreign Application Priority Data

Sep. 30, 2002 (JP) ..... 2002-286170

(51) Int. Cl.[7] ..... B25C 7/00; B27F 7/19
(52) U.S. Cl. ..... 227/131; 227/155
(58) Field of Search ..... 227/131, 155, 227/84, 83, 82, 154, 136

(56) References Cited

U.S. PATENT DOCUMENTS 4,593,847 A * 6/1986 Hagemann ..... 227/155
4,844,319 A * 7/1989 Kurosawa ..... 227/79
5,029,745 A * 7/1991 Akizawa et al. ..... 227/155
5,346,114 A * 9/1994 Udagawa et al. ..... 227/120
5,413,266 A * 5/1995 Jairam ..... 227/129
5,975,396 A * 11/1999 Manabe ..... 227/2
6,056,183 A * 5/2000 Tanabe ..... 227/155
6,164,513 A * 12/2000 Yoshie ..... 227/155
6,371,352 B1 * 4/2002 Mochizuki ..... 227/155

FOREIGN PATENT DOCUMENTS

JP 10-118956 5/1998
JP 2000-153470 6/2000

OTHER PUBLICATIONS

English Language Abstract of JP 2000–153470.
English Language Abstract of JP 10–118956.

* cited by examiner

*Primary Examiner*—Scott A. Smith
(74) *Attorney, Agent, or Firm*—Greenblum & Bernstein, P.L.C.

(57) ABSTRACT

An electric stapler capable of handling multiple sheets of paper. A motor-driven pair of wheel gears turn a swing arm having a symmetrical structure for driving a staple firing assembly and a clinch mechanism, thereby applying large pressure uniformly on staples. The clinch mechanism bends staple legs in different directions so that they do not overlap each other, preventing the clinched part of paper from increasing in the thickness of the stacked paper.

3 Claims, 12 Drawing Sheets

CLINCH MECHANISM FOR STAPLER AND ELECTRIC STAPLER USING THE SAME

The present disclosure relates to subject matter contained in priority Japanese Patent Application No. 2002-286170, filed on Sep. 30, 2002, the contents of which is herein expressly incorporated by reference in its entirety.

BACKGROUND OF THE INVENTION

1. Field of the Invention

The present invention relates to a clinch mechanism for a stapler that drives a staple through stacked sheets of paper with a hammer and clinches the piercing legs of the staple to hold the paper together, and an electric stapler using this clinch mechanism.

2. Description of Related Art

An electric stapler, which automatically drives a staple into an inserted stack of paper, is suitably used for handling a large number of paper or when paper handling is frequently necessary. Commercially available electric staplers include both battery-powered type and AC-powered type. While the former has the advantage of being cordless, the latter is more preferable in that it is free of battery exhaustion; also, the latter can be constructed smaller and more lightweight because it need not accommodate many batteries for supplying power necessary to staple multiple paper sheets.

FIG. 12 illustrates an AC-powered electric stapler shown in Japanese Patent Laid-Open Publication No. 2000-153470 (reference A). A motor 8 rotates a crank gear 25 and turns a crank rod 26, thereby moving a hammer 3 at the distal end of the rod 26 downward to drive a staple accommodated in a staple holder 30 into a stack of paper placed on a clinch plate 32. The legs of the staple penetrated through the stack are bent by the clinch plate 32, thus holding the paper together.

The clinch plate 32 has a guide groove so as to bend legs of driven staples inwards to face each other. This bending of staples by the clinch plate 32 deforms the legs of staples in an arc, so the problem is that the thickness of the stack of paper in the stapled portion is larger than the other portions. Also, this structure with the clinch plate 32 has a drawback that the bending is achieved with less certainty particularly when the stack is thick. In order to staple multiple paper sheets, staples with longer legs are necessary; one requirement here is to clinch the driven staples in a non-overlapping manner so that the clinched part will not cause an increase in the thickness of the stacked paper.

FIG. 13A and FIG. 13B illustrate the construction of a stapler clinch mechanism shown in Japanese Patent Laid-Open Publication No. Hei 10-118956 (reference B), which bends long-legged staples in a non-overlapping manner. Two movable clinchers 53*a,* 53*b* are arranged in grooves 45*a,* 45*b* that are respectively formed between stationary walls 44*a,* 44*b* and receiving plates 43*a,* 43*b* having different thicknesses. The receiving plates 43*a,* 43*b* are formed with guide slopes 48 at locations in point symmetry around the center O therebetween for receiving legs 52*a* of a staple 52. The staple legs 52*a* are guided in opposite directions by the guide slopes 48 into the grooves 45*a,* 45*b* and clinched by the clinchers 53*a,* 53*b*.

Driving staples with long and wide apart legs into multiple sheets requires a large power supply with uniform pressure application.

The conventional electric stapler of the above reference A is structurally incapable of applying large and uniform pressure with the hammer on the staple legs. The clinch plate cannot bend large-sized staple legs; a clinch mechanism is necessitated for heavy duty stapling tasks.

The conventional clinch mechanism of the above reference B, however, has a drawback that staple legs can easily be deformed in a central part because of the symmetric design in which the movable clinchers are accommodated in the grooves formed by oppositely arranged plates with different thicknesses. Thus stable clinching may not be achieved in repeated use applications.

SUMMARY OF THE INVENTION

An object of the present invention is to provide an improved clinch mechanism for a stapler that bends staple legs in a non-overlapping manner, and an electric stapler using this clinch mechanism.

To achieve the above object, the present invention provides a clinch mechanism for a stapler that pushes and drives a staple out of a staple magazine into a stack of paper by a lowering motion of a hammer, and clinches legs of the staple that has penetrated the paper inward to hold the paper together, including: a pair of base plates arranged parallel with a spacing therebetween that conforms to a direction in which the legs of the staple that has penetrated the paper are oriented; a thin-plate partition forming equally spaced gaps on both sides thereof by halving the spacing between the pair of base plates, the partition including a pair of protruding pieces on an top side thereof respectively corresponding to each of staple legs, which protruding pieces are bent in opposite directions at a preset angle to form slanted faces that partly close the equally spaced gaps, respectively; a pair of clinch plates rotatably arranged inside the equally spaced gaps; and a clinch arm for rotating the pair of clinch plates simultaneously with the lowering motion of the hammer.

With this clinch mechanism, the legs of the staple that has penetrated the paper are driven onto the top side of the partition and guided into the equally spaced gaps by the slanted faces of the pair of protruding pieces. The pair of clinch plates disposed in these gaps are then turned by the clinch arm so as to clinch the staple legs to hold the paper together. The staple legs are first bent in opposite directions by the pair of protruding pieces before being clinched by the clinch plates, so that they do not overlap each other and the clinched part of paper is prevented from causing an increase in the thickness of the stacked paper.

The present invention also provides an electric stapler that pushes and drives a staple out of a staple magazine into a stack of paper by a lowering motion of a motor-driven hammer, and clinches legs of the staple that has penetrated the paper inward to hold the paper together, including: a support stand having a pair of upright walls facing each other; a magazine holder holding the staple magazine, arranged between the upright walls, pivotable around an axis at a rear end, and biased upwards; a staple firing assembly including a structure for moving up and down the hammer along a vertical staple firing line at a front end of the support stand and a structure for lowering the staple magazine; a clinch mechanism having a clinch plate disposed below the staple firing line for bending staple legs; a pair of wheel gears attached to the upright walls of the support stand, respectively, and driven by the motor synchronously; a swing arm bridging across the upright walls, turned by the pair of wheel gears to drive the staple firing assembly around a shaft that is biased downwards by a pair of springs; and a clinch arm turned by the pair of wheel gears to drive the clinch mechanism.

With this electric stapler, a large pressure is applied equally on both legs of staples because of the configuration in which the staple firing assembly is driven by the swing arm that is turned by the pair of wheel gears driven by the motor. Staples with long and wide apart legs are thus driven successfully into a thick stack of paper. The pair of wheel gears also rotate the pair of clinch plates of the clinch mechanism through the clinch arm simultaneously with the operation of the staple firing assembly, ensuring clinching of long staple legs.

In this electric stapler constructed as above, the clinch mechanism includes a pair of base plates arranged parallel with a spacing therebetween that conforms to a direction in which the legs of the staple that has penetrated the paper are oriented; a thin-plate partition forming equally spaced gaps on both sides thereof by halving the spacing between the pair of base plates, the partition including a pair of protruding pieces on an top side thereof respectively corresponding to each of staple legs, which protruding pieces are bent in opposite directions at a preset angle to form slanted faces that partly close the equally spaced gaps, respectively; and a pair of clinch plates rotatably arranged inside the equally spaced gaps. This makes it possible to bend the staple legs so that they do not overlap each other.

While novel features of the invention are set forth in the preceding, the invention, both as to organization and content, can be further understood and appreciated, along with other objects and features thereof, from the following detailed description and examples when taken in conjunction with the attached drawings.

DETAILED DESCRIPTION OF THE PREFERRED EMBODIMENTS

Preferred embodiments of the present invention will be hereinafter described with reference to the accompanying drawings.

Figure 1A:
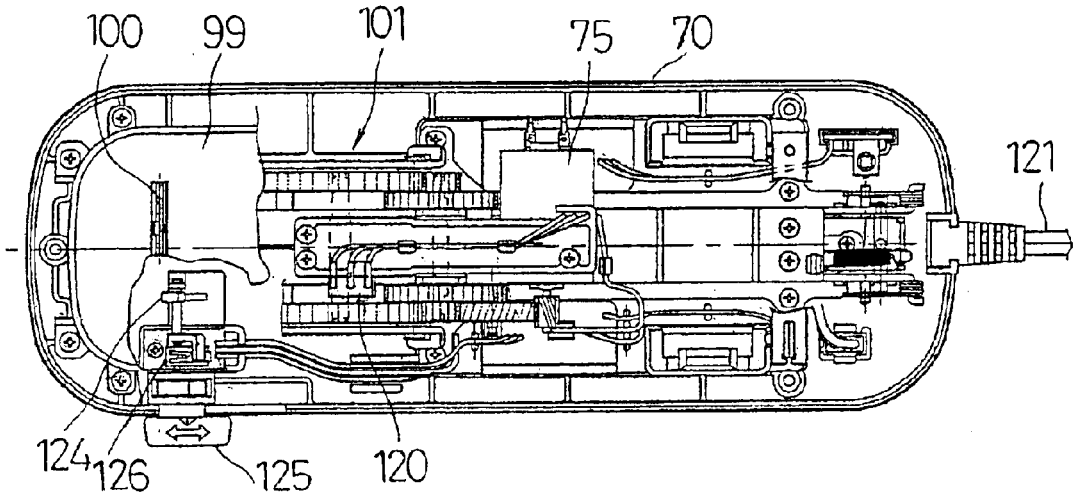
FIG. 1A is a bottom plan view and FIG. 1B is a side view illustrating the internal structure of an electric stapler according to one embodiment of the present invention.
Figure 1B:
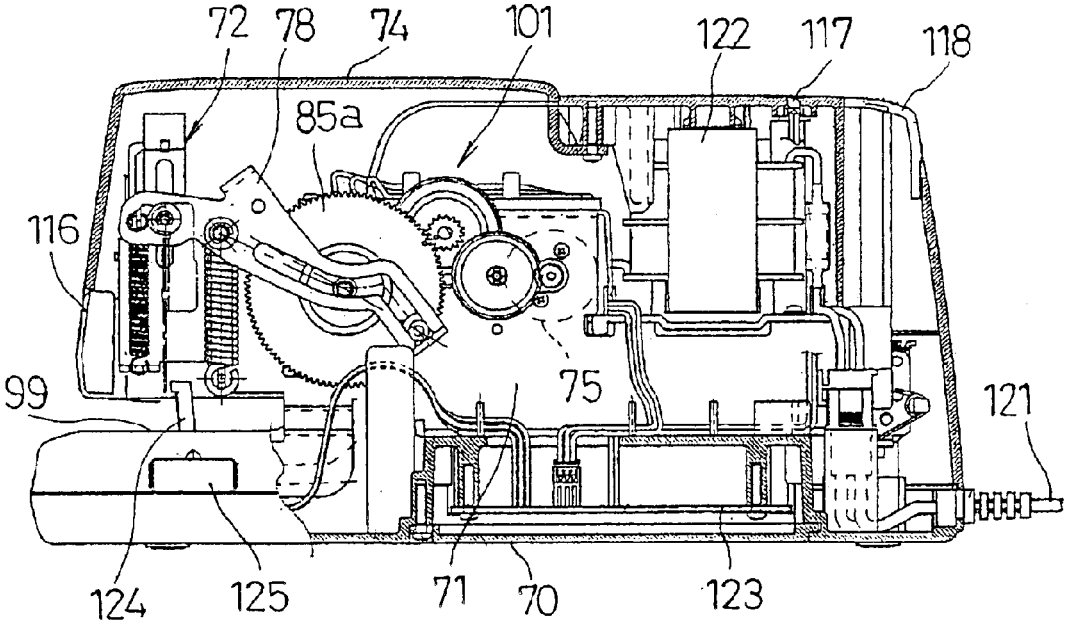
Figure 2A:
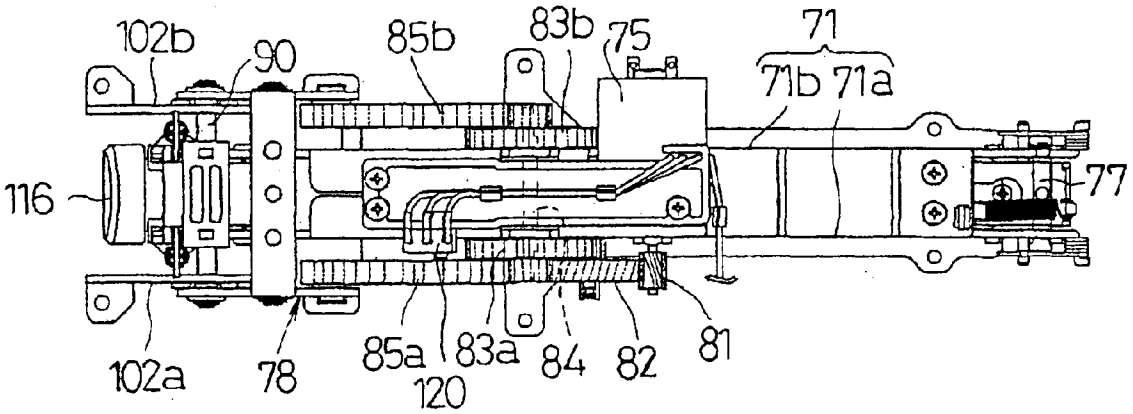
FIG. 2A is a top plan view.
Figure 2B:
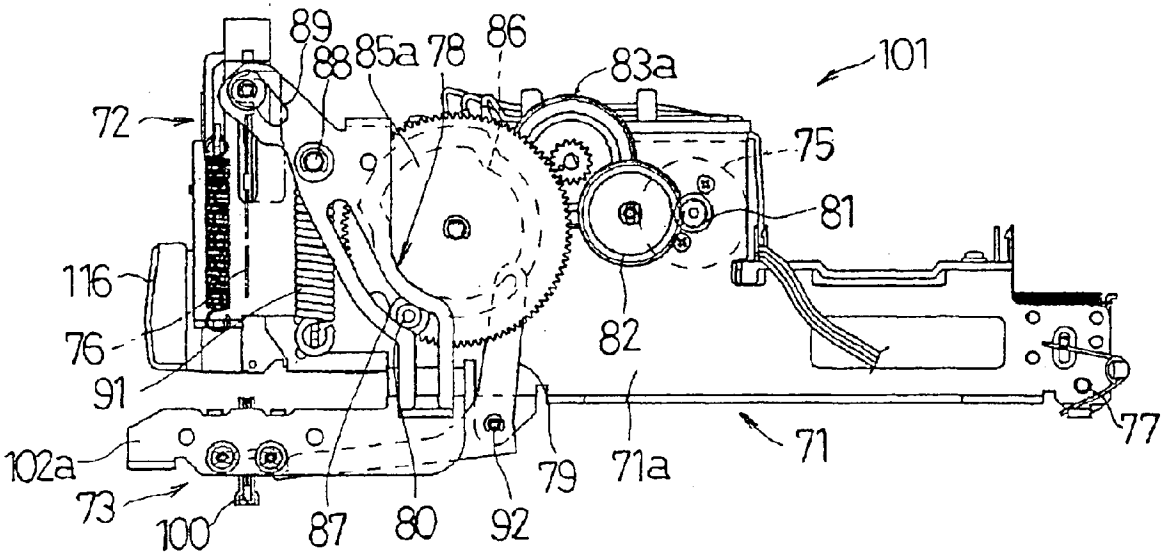
FIG. 2B is a side view.
Figure 2C:
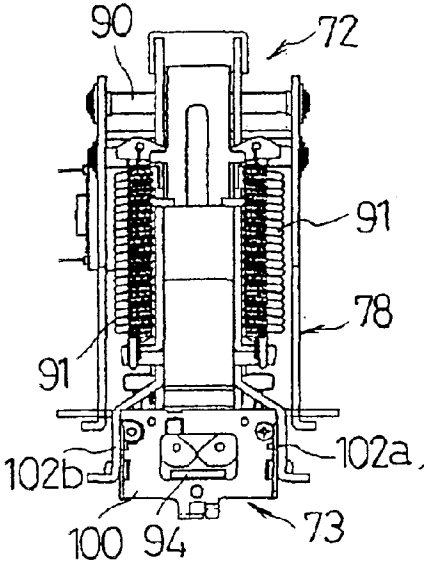
FIG. 2C is a front view, illustrating the structure of a power transmission mechanism in an initial state.
Figure 3A:
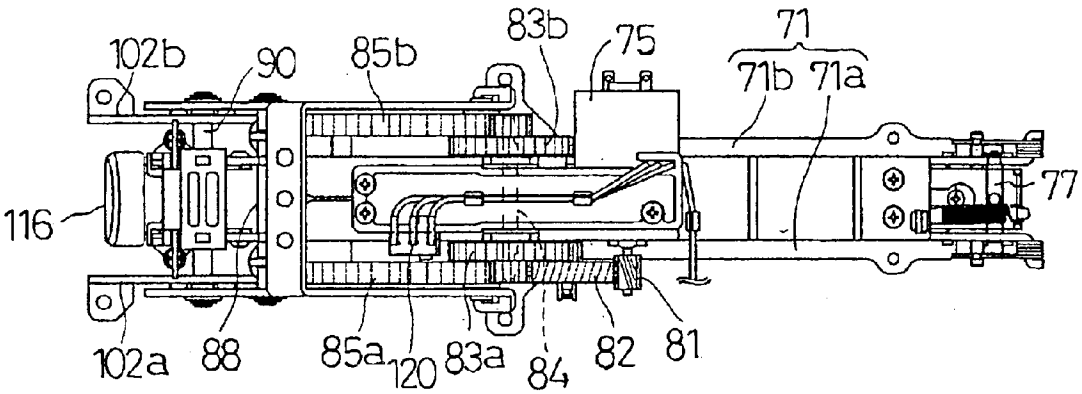
FIG. 3A is a top plan view.
Figure 3B:
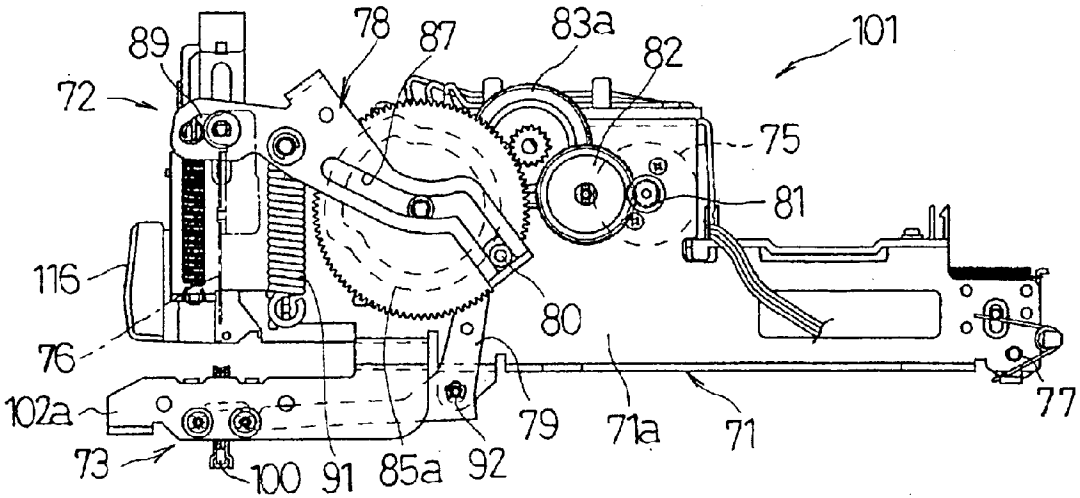
FIG. 3B is a side view.
Figure 3C:
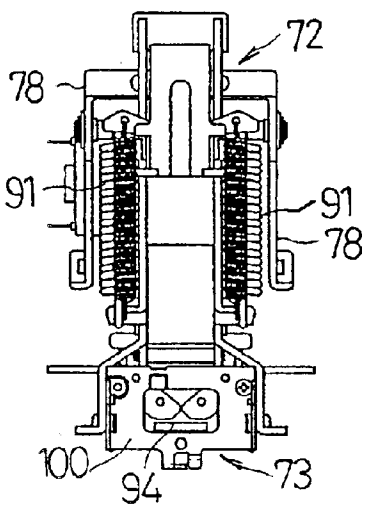
FIG. 3C is a front view, illustrating the structure of the power transmission mechanism when driven.

FIG. 1A and FIG. 1B illustrate the overall structure of an electric stapler according to one embodiment of the invention. Upon a bottom case 70 are arranged a power transmission mechanism 101 and a transducer 122 constituting a power supply device for a staple firing assembly. An upper case 74 is closed on the bottom case 70 to cover these elements. On the front side of the bottom case 70 is a clinch table 99, above which is arranged the upper case 74 such as to form a space for allowing insertion of a stack of paper. A start switch lever 124 stands upright on the clinch table 99. When this lever 124 is pushed by a stack of paper inserted onto the clinch table 99, it turns on a start switch 126 to activate the power transmission mechanism 101, which supplies power to the staple firing assembly 72 for driving staples into stacked sheets and to a clinch mechanism 73 for bending legs of the staple that has penetrated the sheets to hold them together. The stapler automatically shuts off afterwards. Stapling is thus achieved simply by inserting a stack of paper onto the clinch table 99. The stapling position is adjustable in forward or backward direction by changing the position of the lever 124 with a setting knob 125.

The power transmission mechanism 101 is configured upon a support stand 71 fixed on the bottom case 70, as shown in FIG. 2A to FIG. 4C. As is seen from FIG. 2A, the support stand 71 includes a first stand 71a and a second stand 71b that form upright walls standing on the bottom case 70. Between these two stands 71*a* and 71*b* is arranged a magazine holder 115 shown in FIG. 5 that detachably holds a staple magazine 114 accommodating multiple staples. The magazine holder 115 is pivotable around an axis 77 defined at the back end and biased upwards by a spring which is not shown in the drawing. The staple firing assembly 72 for driving staples into stacked paper is configured at the front end of the support stand 71, and the clinch mechanism 73 for bending the legs of staples that have penetrated the stacked paper is configured therebelow. The staple firing assembly 72 and clinch mechanism 73 are both driven by a motor 75 and a gear train.

The motor 75 is mounted to the first stand 71*a*. A motor gear 81 fixed to the shaft of the motor 75 interlocks with a drive gear 82, which rotates a first idler gear 83*a*. The first idler gear 83*a* is fixed on the side of the first stand 71*a* of a shaft 84 that is rotatably supported on the first and second stands 71*a*, 71*b*. A second idler gear 83*b* is fixed to the shaft 84 on the side of the second stand 71*b*, and is rotated together with the first idler gear 83*a* by the drive gear 82. The first idler gear 83*a* and second idler gear 83*b* engage with a first driven gear 85*a* and a second driven gear 85*b*, respectively, thereby rotating them. The drive gear 82, and first and second idler gears 83*a*, 83*b* include pinions integrally formed therewith to achieve preset reduction ratios.

Figure 6A:
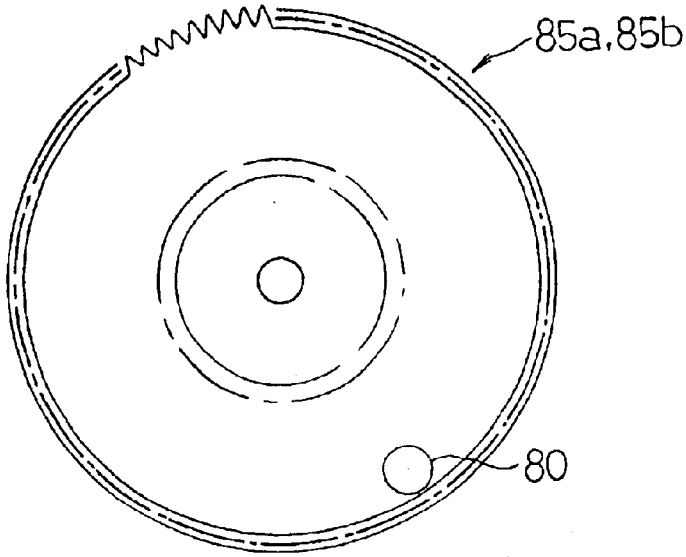
FIG. 6A is a top plan view.
Figure 6B:
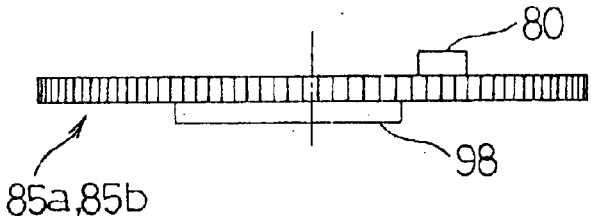
FIG. 6B is a side view.
Figure 6C:
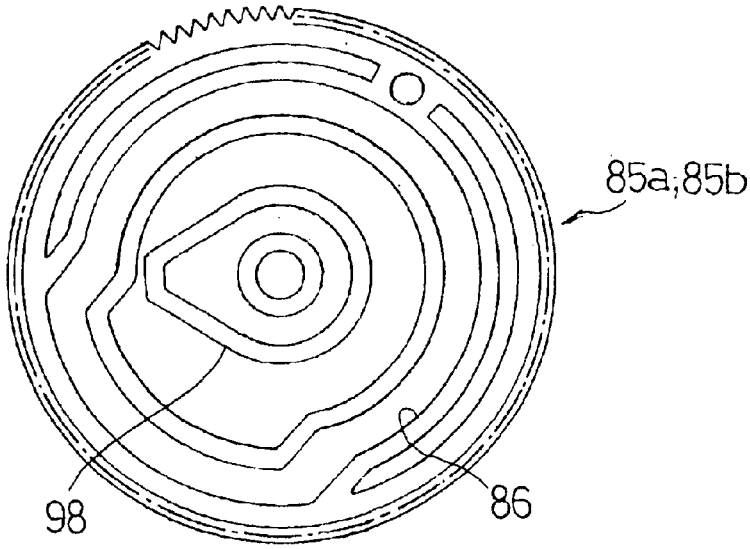
FIG. 6C is a bottom plan view, illustrating a driven gear.
Figure 7:
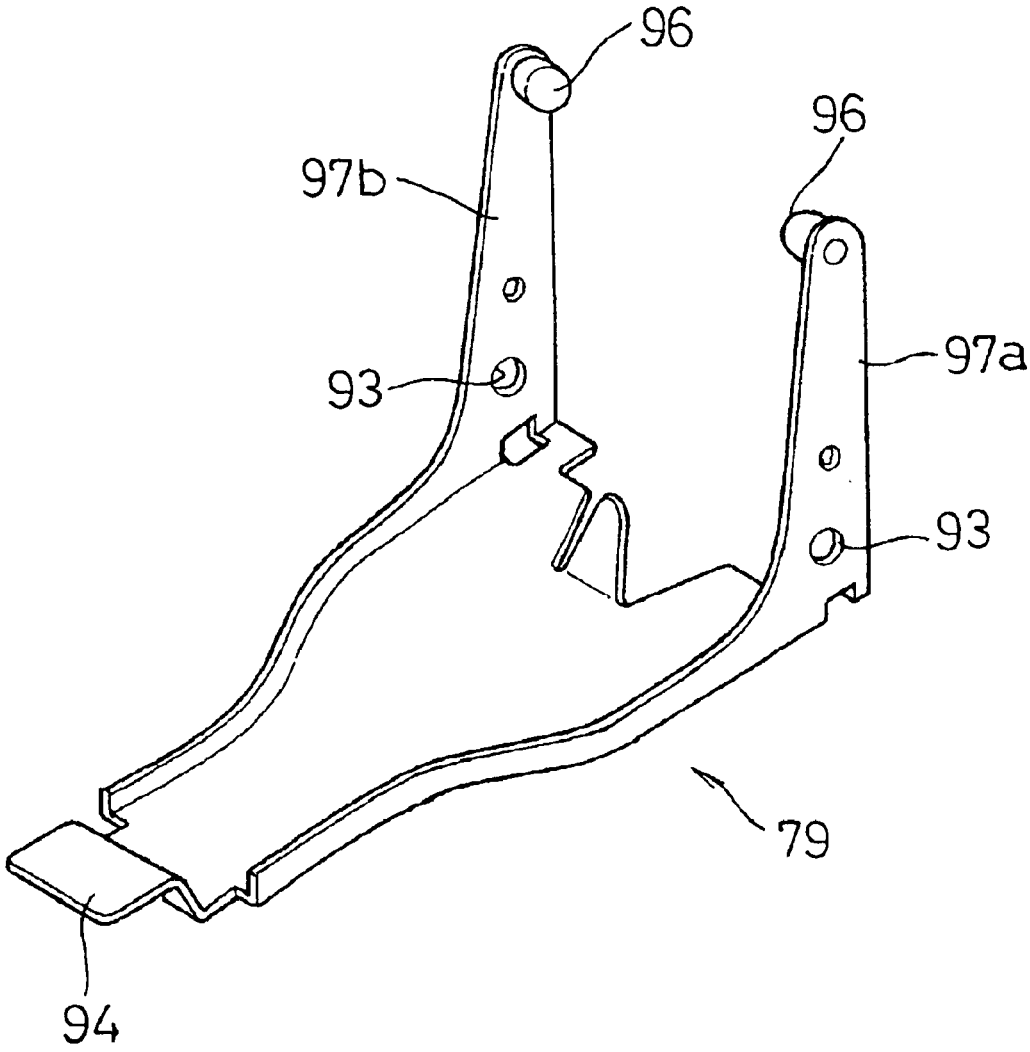
FIG. 7 is a perspective view of a clinch arm.

To the first and second driven gears 85*a*, 85*b* are attached drive pins 80 on the outer face thereof as shown in FIG. 6A. On the inner face are formed cam grooves 86 and switch driving bosses 98 as shown in FIG. 6C. These driven gears 85*a*, 85*b* drive the staple firing assembly 72 and clinch mechanism 73 as they are rotated. The drive pins 80 fit into curved slots 87 formed in a swing arm 78 for driving the staple firing assembly 72. The swing arm 78 and clinch arm 79 have a symmetrical configuration so that their left and right parts are driven synchronously by the first and second driven gears 85*a*, 85*b* on both sides. The clinch arm 79 is formed with rollers 96 at the distal end as shown in FIG. 7, which fit in the cam grooves 86 for the purpose of driving the clinch mechanism 73. The cam grooves 86 are continuous circumferential grooves with differing radii, so that rotation of the first and second driven gears 85*a*, 85*b* turns the clinch arm 79 through engagement between the rollers 96 and cam grooves 86.

The swing arm 78 rests in notches at the top of the first and second stands 71*a,* 71*b* and turns around a support shaft 88 that is biased downward by a pair of springs 91, by the drive pins 80 fitted in the curved slots 87 on both left and right sides. FIGS. 2A–2C through FIGS. 4A–4C illustrate each step that the swing arm 78 goes through as the first and second driven gears 85*a,* 85*b* rotate one turn. With a further rotation of the driven gears 85*a,* 85*b,* the swing arm 78 eventually returns to the position shown in FIGS. 2A–2C. At one end of the swing arm 78 are formed elliptic holes 89 for supporting either end of a drive shaft 90. As the swing arm 78 turns, the drive shaft 90 moves up and down, causing a hammer 76 for driving staples into stacked paper to move up and down, and also pulling the upwardly biased magazine holder downwards.

The clinch arm 79 is configured as shown in FIG. 7. It turns around a shaft 92 passed through holes 93 and supported on the first and second stands 71*a,* 71*b,* causing a pressing piece 94 at one end to move up and down so as to activate a clincher 100 to be described later. The rollers 96, attached at the distal ends of a pair of plates 97*a,* 97*b,* fit in the cam grooves 86 respectively of the first and second driven gears 85*a,* 85*b,* so that the clinch arm 79 turns as the driven gears rotate.

Figure 8A:
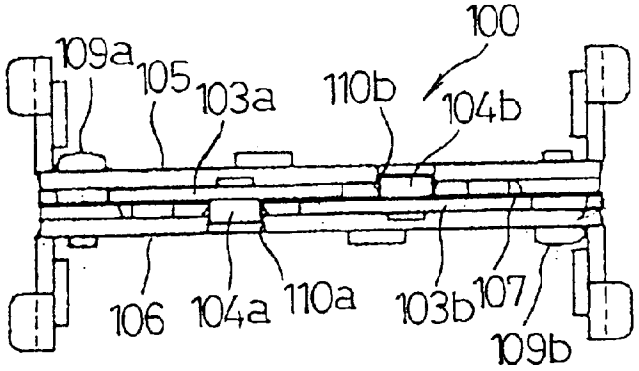
FIG. 8A is a top plan view.
Figure 8B:
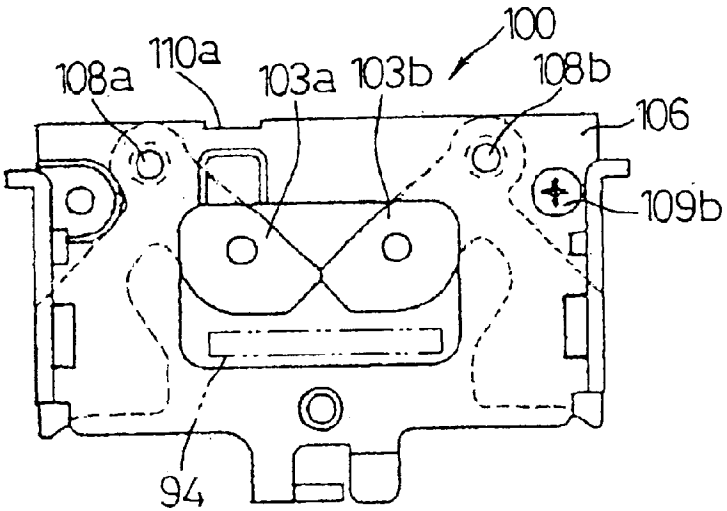
FIG. 8B is a front view.
Figure 8C:
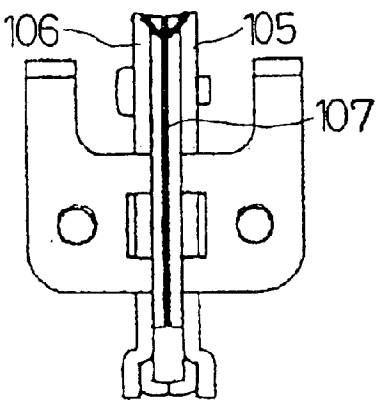
FIG. 8C is a side view, illustrating the structure of a clincher.

The clincher 100 has a pair of movable clinch plates 103*a,* 103*b* arranged in a gap between base plates 105, 106 in a rotatable manner as shown in FIG. 8A to FIG. 8C. These clinch plates 103*a,* 103*b* are driven by the pressing piece 94 of the clinch arm 79 to bend the legs of staples that have penetrated stacked paper. The base plates 105, 106 are respectively attached to support arms 102*a,* 102*b* extending from the first and second stands 71*a,* 71*b,* whereby the clincher 100 is located below the staple firing assembly 72.

Figure 9:
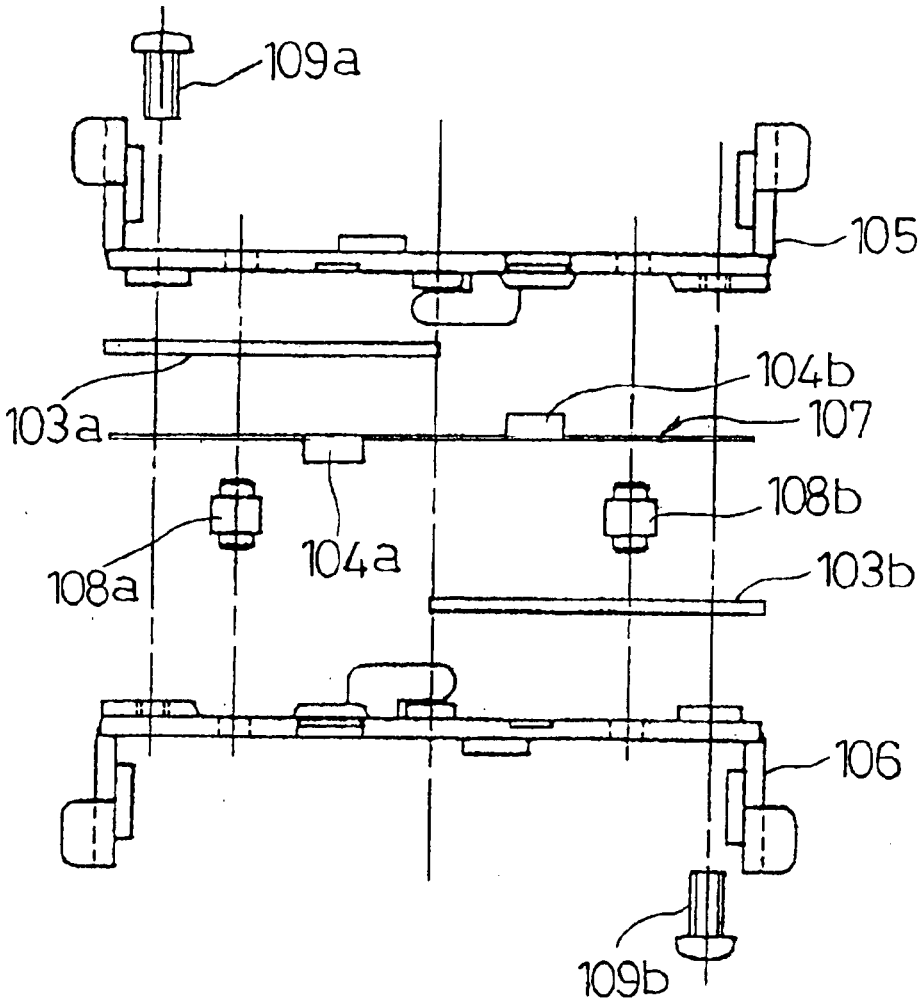
FIG. 9 is an exploded plan view of the clincher.
Figure 10A:
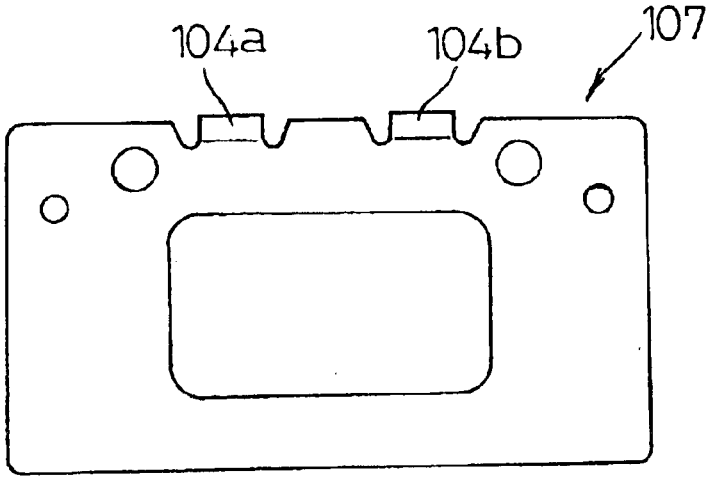
FIG. 10A is a top plan view and FIG. 10B is a side view of a partition.
Figure 10B:
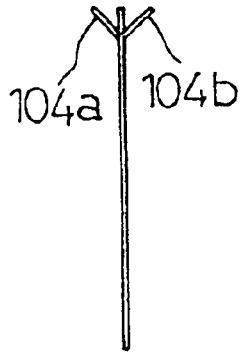
Figure 11:
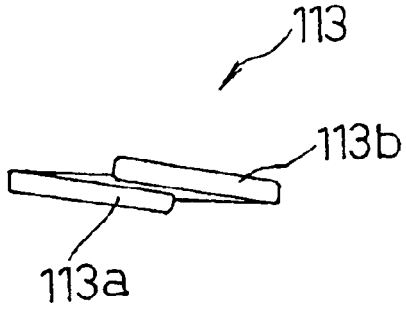
FIG. 11 is a top plan view of a clinched staple.
Figure 12:
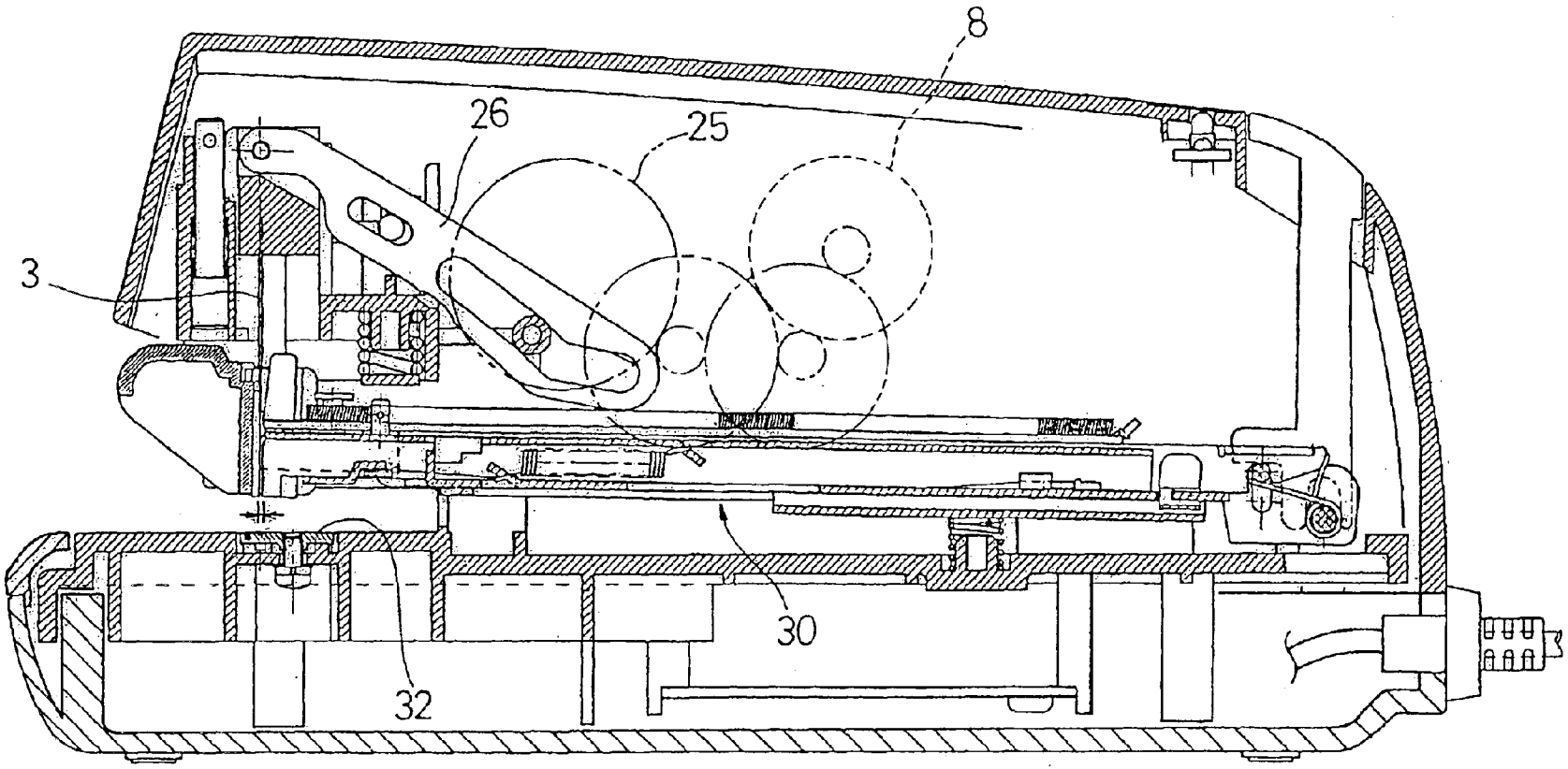
Fig. 12 Prior Art
FIG. 12 is a cross-sectional view illustrating the structure of a conventional electric stapler.
Figure 13A:
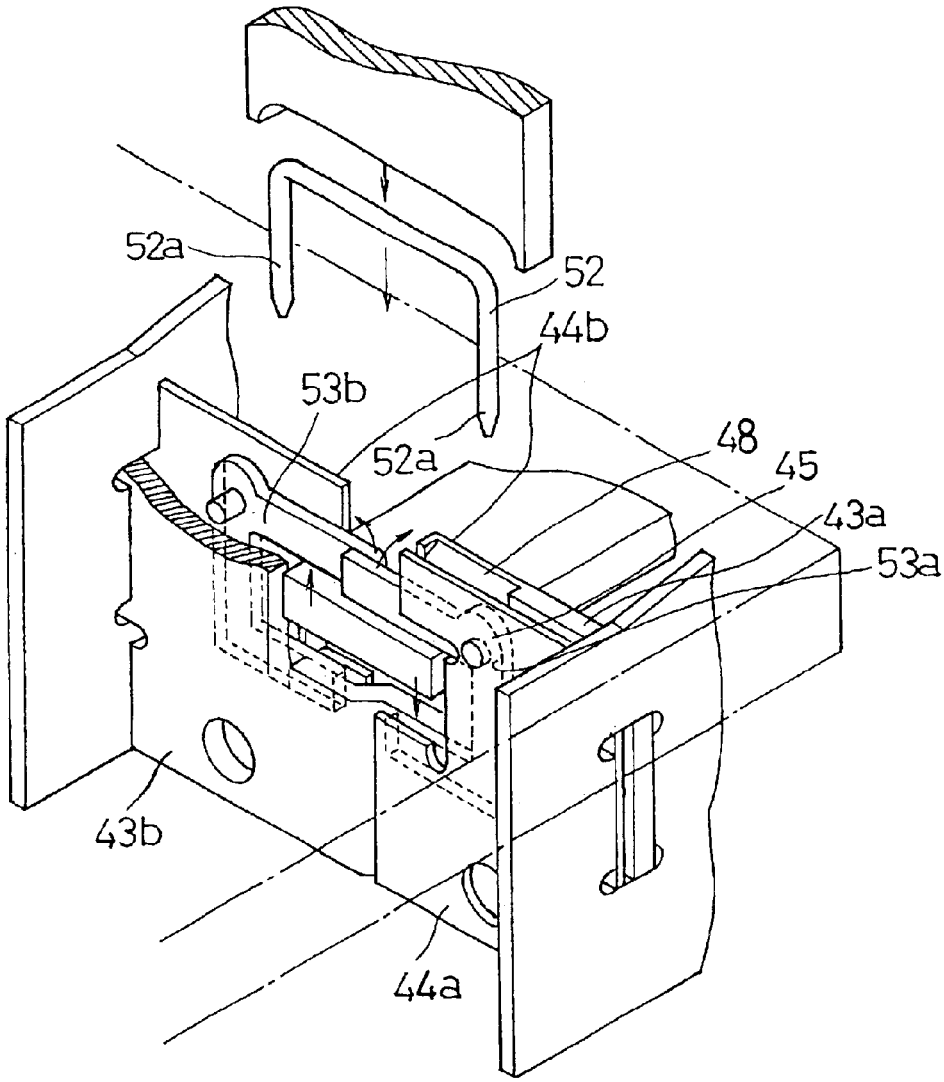
Prior Art Fig. 13A
FIG. 13A is a perspective view and FIG. 13B is a top plan view illustrating the structure of a conventional clinch mechanism.
Figure 13B:
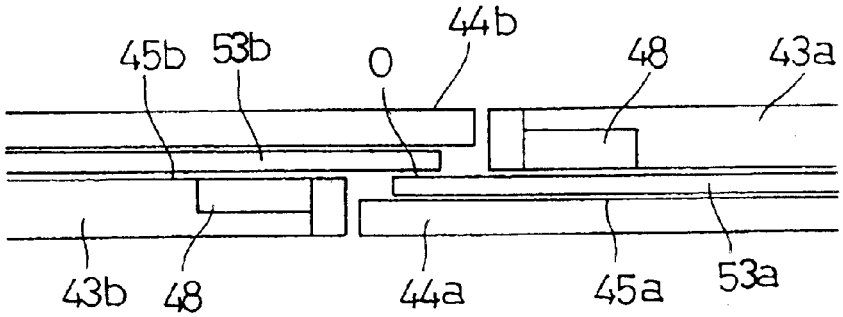

Between the parallel clinch plates 103*a,* 103*b* is interposed a partition 107 shown in FIG. 10A made of a thin metal sheet. FIG. 9 shows the constituent elements of the clincher 100 in an exploded view. The partition 107 is formed with a pair of slanted lugs (protruding pieces) 104*a,* 104*b*. As is seen from FIG. 10B, the slanted lug 104*a* is bent at about 45° toward the side of the base plate 106, while the other lug 104*b* is bent at about 45° toward the opposite side. The distance between the centers of the lugs 104*a,* 104*b* corresponds to the distance between staple legs.

Referring to FIG. 9, the base plate 105 has holes for receiving one end of shafts 108*a,* 108*b,* and the movable clinch plate 103*a,* partition 107, and the other clinch plate 103*b* are superposed thereon in this order, the shafts 108*a,* 108*b* passing through holes respectively formed in these parts. Lastly, the other end of the shafts 108*a,* 108*b* is fitted into holes in the base plate 106, and screws 109*a,* 109*b* are tightened from both sides into the holes in the opposite base plates 105, 106, whereby the clincher 100 shown in FIG. 8A to FIG. 8C is formed. The tips of the lugs 104*a,* 104*b* respectively rest on notches 110*a,* 110*b* formed on the base plates 106, 105, as shown in FIG. 8A.

The clincher 100 is disposed such that the partition 107 is located directly below the plate-like hammer in the staple firing assembly 72. When the assembly 72 is driven to fire a staple by the hammer, its legs penetrate through stacked paper and are driven onto the lugs 104*a,* 104*b* of the partition 107. The slanted faces of the lugs 104*a,* 104*b* direct the staple legs in opposite directions and bent them onto the clinch plates 103*a,* 103*b,* respectively. Turning the clinch plates 103*a,* 103*b* in this state by the clinch arm 79 bends the legs 113*a,* 113*b* of the staple 113 so as to be offset relative to the partition 107, thus forming a non-overlapping clinch.

AC power is used both for powering the motor 75 of the power transmission mechanism 101 and for the overall control. The electric circuit is constructed roughly as follows: AC power supplied through a cord 121 is decreased in voltage to a preset level by a transducer 122 and converted into DC power by a rectifying circuit configured on a control circuit substrate 123 so as to constitute a DC power source for the motor 75 and control circuit. The control circuit controls the motor 75 based on an ON/OFF input from a switch suitably provided to a movable component, and detects abnormality such as crunching of a staple.

Referring to FIG. 1A and FIG. 1B, to start the stapler, a stack of paper is inserted onto the clinch table 99 formed with an opening above the clincher 100 to push in the start switch lever 124, turning on the start switch 126. This information is input to the control circuit 123, which in turn activates the motor 75 to rotate the first and second driven gears 85*a,* 85*b* from the angle position shown in FIG. 2B, to turn the swing arm 78 by the drive pins 80. When the swing arm 78 reaches the angle position shown in FIG. 3B, the drive shaft 90 engaging with the elliptic holes 89 are moved downward by the swing arm 78 to lower the hammer 76. At the same time, the magazine holder is lowered so that its bottom end makes pressure contact with the stack of paper on the clinch table 99.

Figure 4A:
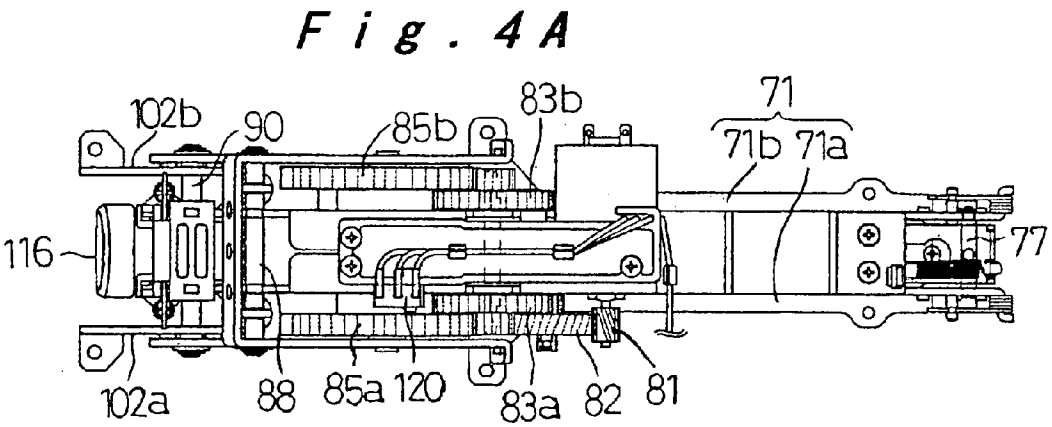
FIG. 4A is a top plan view.
Figure 4B:
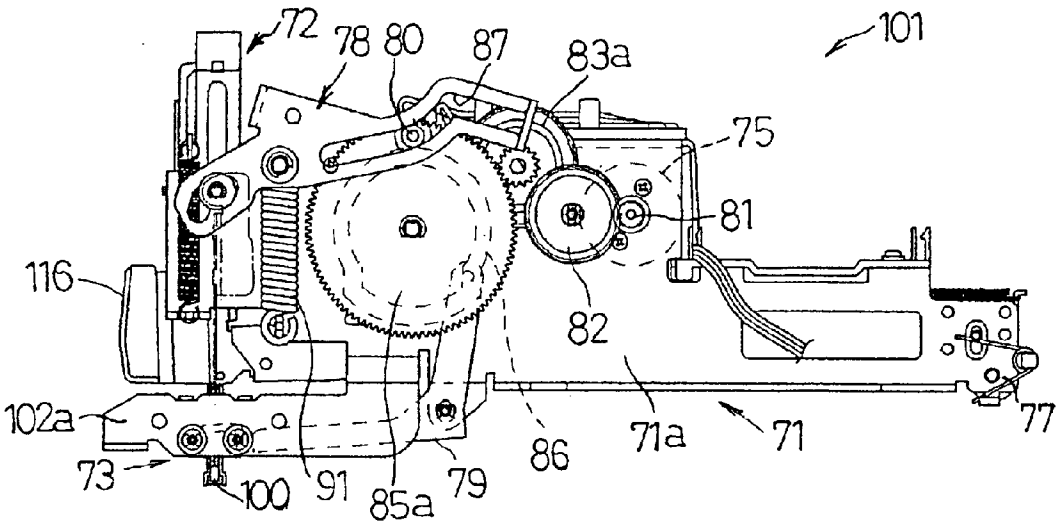
FIG. 4B is a side view.
Figure 4C:
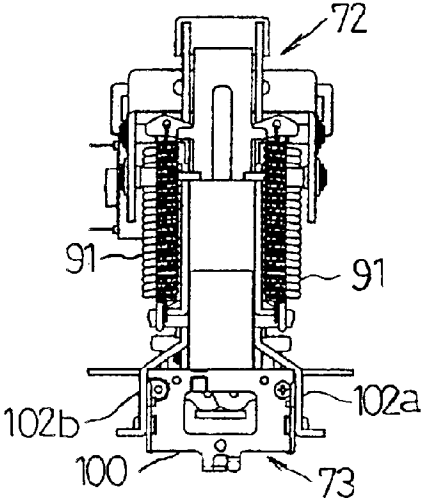
FIG. 4C is a front view, illustrating the structure of the power transmission mechanism when firing a staple.
Figure 5:
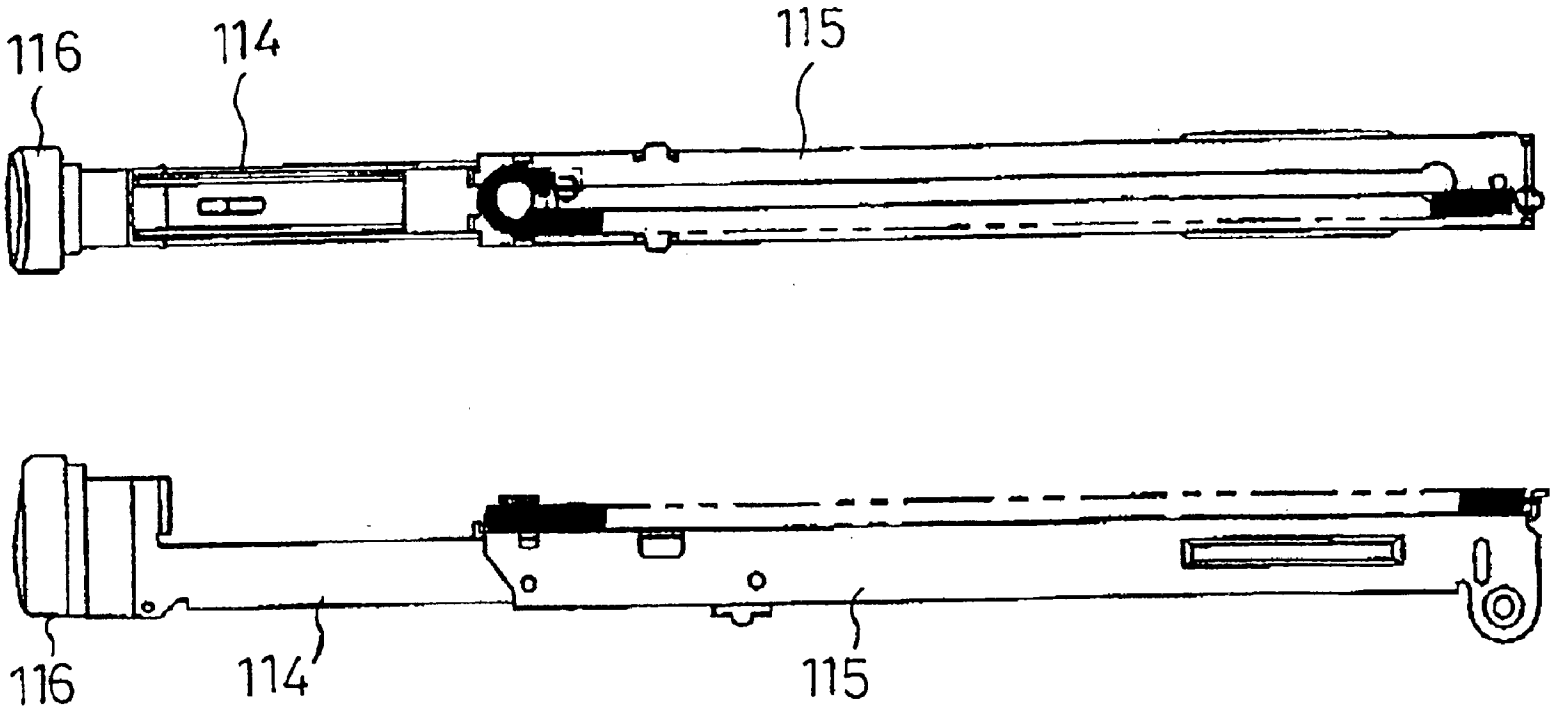
FIG. 5 shows a magazine holder in plan and side views.

A further rotation of the first and second driven gears 85*a,* 85*b* turns the swing arm 78 to the angle position shown in FIG. 4B, where a large drive force is applied to the hammer 76 by the downward bias of the springs 91 on both sides, the hammer 76 thereby pushing a staple out of the staple magazine and driving it into the stack of paper. The position in up and down direction of the support shaft 88 is adjustable by the pair of springs 91 that are biasing the shaft 88 downward in accordance with the thickness of the stack so that the hammer 76 exerts constant drive force irrespective of the thickness of the stack.

Instantly after this staple firing into the stack of paper, the rollers 96 of the clinch arm 79 engaging with the cam grooves 86 of the driven gears 85*a,* 85*b* enter the large radius zone of the cam grooves 86, turning the clinch arm 79, which then turns the pair of clinch plates 103*a,* 103*b* by the pressing piece 94 at the distal end. The legs of the staple that has penetrated the stacked paper and inserted into the clincher 100 are thereby clinched, holding the stack of paper together. The staple legs are bent in different directions, not overlapping each other.

The driven gears 85*a,* 85*b* further rotate after this clinching operation, thereby turning the distal end of the swing arm 78 upward by the drive pins 80 to lift up the hammer 76. The rollers 96 enter the small radius zone of the cam grooves 86, thereby turning the clinch arm 79 to move its pressing piece 94 downward. In returning of the driven gears 85*a,* 85*b* to the angle position shown in FIG. 2B after rotating one turn, the switch driving boss 98 on the first driven gear 85*a* turns on a stop switch 120. When this information is input to the control circuit, the motor 75 is stopped, and the stapling operation is completed.

The electric stapler starts up automatically when a stack of paper is inserted onto the clinch table 99. Should an abnormality arise such as crunching of a staple, the control circuit lights up an indication lamp 117. The lamp 117 is lit all through while the power transmission mechanism 101 is operating, with the start switch lever 124 being pushed by a stack of paper, to indicate that the stapler is in operation. The indication lamp 117 is also illuminated in a suitable manner when the staples 113 in the staple magazine 114 have run out, so as to notify the user of the need to reload staples 113. Pushing an eject button 118 downward releases the hold of the staple magazine 114 by the magazine holder 115, allowing the staple magazine 114 to eject out to the front by the biasing force of a spring. Staples 113 can then be reloaded into a mouth of the staple magazine. The staple magazine 114 is reset into the magazine holder 115 by pressing a knob 116 at the front end thereof.

The clincher 100 of the invention can also be applied to a manually operated stapler for achieving flat clinch stapling.

According to the invention, the electric stapler successfully handles multiple sheets of paper because it applies a large, uniform pressure on large and long-legged staples. The clinch mechanism has such a structure that the clinching effect does not deteriorate over time and is applicable to a powerful staple firing assembly. Moreover, the clinch mechanism bends the staple legs in different directions so as not to overlap each other, allowing the paper sheets to stack more neatly.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A clinch mechanism for a stapler that pushes and drives a staple out of a staple magazine into a stack of paper by a lowering motion of a hammer, and clinches legs of the staple that has penetrated the paper inward to hold the paper together, the clinch mechanism comprising:

a pair of base plates arranged parallel with a spacing therebetween that conforms to a direction in which the legs of the staple that has penetrated the paper are oriented;

a thin-plate partition forming equally spaced gaps on both sides thereof by halving said spacing between said pair of base plates, the partition including a pair of protruding pieces on a top side thereof respectively corresponding to each of staple legs, said protruding pieces being bent in opposite directions at a preset angle to form slanted faces that partly close said equally spaced gaps, respectively;

a pair of clinch plates rotatably arranged inside said equally spaced gaps; and a clinch arm for rotating said pair of clinch plates simultaneously with said lowering motion of the hammer.

2. An electric stapler that pushes and drives a staple out of a staple magazine into a stack of paper by a lowering motion of a motor-driven hammer, and clinches legs of the staple that has penetrated the paper inward to hold the paper together, the electric stapler comprising:

a support stand having a pair of upright walls facing each other;

a magazine holder holding said staple magazine, arranged between said upright walls, pivotable around an axis at a rear end of the support stand, and biased upwards;

a staple firing assembly including a structure for moving up and down the hammer along a vertical staple firing line at a front end of the support stand and a structure for lowering said staple magazine;

a clinch mechanism having a clinch plate disposed below said staple firing line for bending staple legs;

a pair of wheel gears attached to the upright walls of the support stand, respectively, and driven by the motor synchronously;

a swing arm bridging across the upright walls, turned by the pair of wheel gears to drive said staple firing assembly around a shaft that is biased downward by a pair of springs; and a clinch arm turned by the pair of wheel gears to drive said clinch mechanism.

3. The electric stapler according to claim 2, wherein said clinch mechanism comprises:

a pair of base plates arranged parallel with a spacing therebetween that conforms to a direction in which the legs of the staple that has penetrated the paper are oriented;

a thin-plate partition forming equally spaced gaps on both sides thereof by halving said spacing between said pair of base plates, the partition including a pair of protruding pieces on a top side thereof respectively corresponding to each of staple legs, said protruding pieces being bent in opposite directions at a preset angle to form slanted faces that partly close said equally spaced gaps, respectively; and a pair of clinch plates rotatably arranged inside said equally spaced gaps.

* * * * *